US009950233B2

(12) United States Patent
Bilbao

(10) Patent No.: US 9,950,233 B2
(45) Date of Patent: Apr. 24, 2018

(54) METHOD FOR TRAINING AND ASSISTING ALPINE SKIERS

(71) Applicant: Sebastian Bilbao, Brooklyn, NY (US)

(72) Inventor: Sebastian Bilbao, Brooklyn, NY (US)

( * ) Notice: Subject to any disclaimer, the term of this patent is extended or adjusted under 35 U.S.C. 154(b) by 554 days.

(21) Appl. No.: 13/895,060

(22) Filed: May 15, 2013

(65) Prior Publication Data

US 2013/0316317 A1 Nov. 28, 2013

Related U.S. Application Data

(62) Division of application No. 12/683,660, filed on Jan. 7, 2010, now abandoned.

(60) Provisional application No. 61/143,334, filed on Jan. 8, 2009, provisional application No. 61/144,427, filed on Jan. 13, 2009.

(51) Int. Cl.

| | |
|---|---|
| ***A63B 69/18*** | (2006.01) |
| ***A63C 5/16*** | (2006.01) |
| ***A63C 11/10*** | (2006.01) |
| ***A63B 21/00*** | (2006.01) |
| *A63B 21/28* | (2006.01) |
| *A63B 69/00* | (2006.01) |

(52) U.S. Cl.

CPC ..... *A63B 69/182* (2013.01); *A63B 21/4015* (2015.10); *A63B 69/18* (2013.01); *A63C 5/16* (2013.01); *A63C 11/10* (2013.01); *A63B 21/285* (2013.01); *A63B 69/0057* (2013.01); *A63B 69/0059* (2013.01)

(58) Field of Classification Search

CPC . A63B 69/18; A63B 69/0057; A63B 69/0059; A63B 2069/0062

USPC ..... 434/253

See application file for complete search history.

(56) References Cited

U.S. PATENT DOCUMENTS

| | | | | |
|---|---|---|---|---|
| 2,860,424 | A | 11/1958 | McKinnou | |
| 2,946,305 | A | 7/1960 | Hill | |
| 2,956,541 | A | 10/1960 | Rall | |
| 3,088,748 | A | 5/1963 | Malmo | |
| 3,125,060 | A | 3/1964 | Leonard | |
| 3,227,126 | A | 1/1966 | Etzler | |
| 3,448,989 | A * | 6/1969 | Marker | 280/637 |
| 3,549,163 | A * | 12/1970 | Wiedermann | 280/637 |

(Continued)

FOREIGN PATENT DOCUMENTS

| | | |
|---|---|---|
| DE | 3521146 | 12/1986 |
| WO | WO 99/30786 | 6/1999 |
| WO | WO 2007/052080 | 5/2007 |

*Primary Examiner* — Melba Bumgarner

*Assistant Examiner* — Joseph B Baldori

(74) *Attorney, Agent, or Firm* — Dorsey & Whitney LLP

(57) ABSTRACT

A method and device are provided that allow a competent skier to train and/or assist a trainee downhill skier with the acquisition of basic downhill skiing techniques. The trainee skier is tethered to an uphill instructing skier by a pair of reins attached to the trainee at the ankles, ski tips, or to the ski tips via ski tip handles. The instructing skier has substantially independent control over each tethering point to assist or train the novice skier to execute turns, control speed, and promote proper balance and stance for the maneuver and terrain at hand. The method and device may also comprise the use of adjustable ski tip couplers that limit divergence, and optionally convergence, of the trainee's ski tips. Handicapped skiers may be assisted and guided in downhill skiing using this method and device.

23 Claims, 8 Drawing Sheets

(56) References Cited

U.S. PATENT DOCUMENTS

| | | | | | |
|---|---|---|---|---|---|
| 3,703,299 | A | | 11/1972 | Kutchma | |
| 3,752,474 | A | | 8/1973 | Macaber et al. | |
| 3,854,739 | A | | 12/1974 | Toda et al. | |
| 3,973,333 | A | | 8/1976 | Caris | |
| 3,992,022 | A | | 11/1976 | Albers | |
| 4,234,211 | A | * | 11/1980 | Lux | 280/810 |
| 4,424,040 | A | | 1/1984 | Buchheister et al. | |
| 4,505,681 | A | | 3/1985 | Jones | |
| 4,509,921 | A | | 4/1985 | Buchheister et al. | |
| 4,587,870 | A | * | 5/1986 | Colburn | 81/15.9 |
| 4,643,444 | A | | 2/1987 | Parkinson | |
| 4,653,205 | A | * | 3/1987 | Koch | 36/118.6 |
| 4,706,957 | A | | 11/1987 | Jackson | |
| 4,828,288 | A | | 5/1989 | Humbert | |
| 4,846,690 | A | | 7/1989 | Williams | |
| 4,936,603 | A | | 6/1990 | Reynaud | |
| 4,977,692 | A | * | 12/1990 | Iwama et al. | 36/117.7 |
| 5,074,795 | A | | 12/1991 | Clark | |
| D366,083 | S | | 1/1996 | Zemke | |
| 5,531,480 | A | | 7/1996 | Foertsch | |
| 5,911,611 | A | | 6/1999 | Saad | |
| 6,027,001 | A | | 2/2000 | Levitan | |
| 6,592,377 | B2 | | 7/2003 | Bendele | |
| 7,052,044 | B1 | | 5/2006 | Streeter | |
| 2006/0110716 | A1 | | 5/2006 | Micari et al. | |
| 2008/0136246 | A1 | | 6/2008 | Salter | |
| 2009/0039635 | A1 | | 2/2009 | Bailey | |
| 2010/0078900 | A1 | | 4/2010 | Kauanoe | |
| 2010/0173273 | A1 | * | 7/2010 | Bilbao | 434/253 |
| 2011/0269107 | A1 | * | 11/2011 | Coleman et al. | 434/253 |
| 2011/0269108 | A1 | * | 11/2011 | Coleman et al. | 434/253 |

* cited by examiner

METHOD FOR TRAINING AND ASSISTING ALPINE SKIERS

CROSS REFERENCE TO RELATED APPLICATIONS

This application is a division application of U.S. patent application Ser. No. 12/683,660 filed Jan. 7, 2010 and claims priority benefits under 35 U.S.C. § 119(e) from U.S. Provisional Patent Applications: Ser. No. 61/143,334 entitled "Method and Device for Training and Assisting Alpine Skiers", filed on Jan. 8, 2009 and Ser. No. 61/144,427 entitled "Method and Device for Training and Assisting Alpine Skiers", filed on Jan. 13, 2009, which are hereby incorporated by reference in their entirety.

BACKGROUND OF THE INVENTION

The skill of downhill skiing is achieved by combining the appropriate posture, orientation and balance of the different quadrants of the body in accordance with the terrain and maneuver at hand. Ideally the shoulders, hips and skis are maneuvered fairly independently when skiing. Improved results in training or assisting downhill skiers are obtained when the trainee derives these skills experientially, without intrusive interference from an instructor. The present disclosure primarily concerns a method and device for training novice skiers which leaves their upper body free, to encourage them to independently find their appropriate balance, while offering an instructing skier some degree of influence over the trainee skier's direction, speed and balance development.

As used herein, the term "trainee" is a skier who is fitted with a ski training device, for example, to allow another person to teach, train, assist or guide that skier in skiing. The trainee can be, for example, a beginner or student skier, a child or an adult, a capable skier attempting more difficult conditions or steeper terrain than they are accustomed to, or a physically handicapped or disabled skier. As used herein the term "instructor" refers to a person who is assisting a trainee, and can include, for example, a ski instructor or guide, a parent or ski partner. The instructor need not be a professional ski instructor; however, preferably the instructor is a competent skier with an understanding of proper ski technique. The instructor is typically also on skis, although in some situations the instructor can use the present device and method while on foot or on a snowboard or other suitable device.

Of the various patented and/or commercially available downhill ski training devices and associated methods, the present invention probably has most similarities with ski harnesses via which a trainee is connected to an instructor. Most commercially available ski harnesses are of the torso kind, by which an instructor directly manipulates the bearer's torso. The steering control provided by these torso harnesses is minimal and difficult to impart, and they also have the intrinsic characteristic of tending to urge the skier's upper body backwards when the instructor pulls on the harness to steer or control speed, which interferes with training or assisting trainees. Examples of torso harnesses are products marketed by Lucky Bums, RC Products and Kuu as well as those described in U.S. Pat. Nos. 4,424,040; 4,509,921; and 5,074,795. U.S. Pat. No. 4,505,681 describes a device involving tethering at the ankles without providing individual or separate control over them, making direct steering fundamentally unattainable.

In contrast to commonly-used devices and methods, use of the present device does not involve applying forces directly to the trainee's upper body which tends to disrupt their balance, but rather allows an instructor to aid a trainee in determining and adopting the correct stance and balance for the maneuver and terrain at hand.

The instructor can evaluate the terrain, meteorological conditions and skill level of the trainee in order to select the appropriate embodiment of the present disclosure to be used with the trainee. Three preferred embodiments grant an instructor the option of tethering a trainee with reins at one of three paired points: the ankles, the ski tips, or the ski tips via ski tip handles, while the trainee's ski tips can be coupled together to limit their relative motion. Thus, an instructor can independently manipulate the appropriate pair of tethering points directly, thereby assisting the trainee with simple turns, speed control and independent balance development without adversely disrupting the motion or position of the trainee's upper body.

SUMMARY OF THE INVENTION

The present invention relates to a ski training device for use by an instructor in training or assisting a trainee. The device comprises a pair of reins which are held by the instructor, each end of which is to be secured to the trainee at one of the following paired connecting points: the ankles, ski tips or ski tip handles, herein referred to as "tethering points". Each rein can be independently manipulated by the instructor to influence either the right or left tethering point. The device optionally further comprises a ski tip coupler, that can be used to limit the relative motion of the trainee's ski tips.

Thus, a ski training device for use by an instructor in assisting a trainee, comprises left and right reins to, be held by the instructor. Each rein is connectable to corresponding left and right tethering points associated with the trainee's ankles or ski tips. During use of the device, each rein can be manipulated substantially independently by the instructor to adjust the motion of the corresponding tethering point. Preferably each rein comprises a connector for releasably connecting the rein to the corresponding tethering point.

A method of assisting a trainee downhill skier comprises tethering the trainee to an instructor with a device comprising a pair of reins. Each rein extends from one hand of the instructor to a corresponding tethering point associated with the trainee's ankles or ski tips, whereby each rein can be manipulated substantially independently by the instructor to adjust the motion of the corresponding tethering point.

In the above-described device and method, preferably the length of the reins is adjustable. The left and right reins can be separate, for example, comprising two independent lines running from each tethering point and terminating at each corresponding hand of the instructor. However the device tends to be easier to use if the reins comprise a single continuous strap that, during use, extends between the left and right hands of the instructor and is held approximately mid-way by the instructor. In the fatter embodiments, the continuous strap, can be formed from single piece or from two more component pieces that are releasably or permanently linked together.

In embodiments of the ski training device and method in which the tethering points are associated with the trainee's ankles, the device can further comprise a pair of ankle bands for securing around each ski boot of the trainee, and connectors for releasably connecting the left and right reins to the corresponding ankle band.

In other embodiments of the ski training device and method in which the tethering points are associated with the trainee's ankles, the device can further comprise boot anchors for attaching to the trainee's ski boots, and connectors for releasably connecting the left and right reins to the corresponding boot anchor.

In yet further embodiments of the ski training device and, method in which the tethering points are associated with the trainee's ankles, the device can further comprise connectors for releasably connecting the left and right reins to the trainee's corresponding ski boot binding.

In embodiments of the ski training device and method in which the tethering points are associated with the trainee's ski tips, the device can further comprise left and right ski tip anchors for attaching to the trainee's ski tips, and tip-connectors for releasably connecting the left and right reins to the corresponding ski tip anchors. In some embodiments, the device further comprises left and right ski tip handles for the trainee to hold, wherein each rein comprises a first section extending between the ski tip anchor and the ski tip handle and a second section extending between the ski tip handle and the portion of the rein held by the instructor. In this case, the device can further comprise ski handle-connectors for releasably connecting the second section of each rein to the corresponding ski tip handle. Preferably the length of at least the first section of each rein is adjustable (between the ski tip anchors and the ski tip handles held by the trainee), for example, to allow the trainee a relaxed forward stance when gripping the handles.

In any of the above-described embodiments, the ski training device optionally further comprises a ski tip coupler for linking the trainee's ski tips. In preferred embodiments the ski tip coupler comprises an elastic member for limiting divergence of the trainee's ski tips and a rigid member for limiting convergence of the trainee's ski tips. Thus, the method optionally comprises linking the trainee's ski tips using a ski tip coupler, wherein the ski tip coupler limits the divergence and/or convergence of the trainee's ski tips. Use of a ski tip coupler is particularly beneficial in embodiments of the device and method in which the tethering points are at the ski tips (with or without intermediate ski tip handles).

In any of the above-described embodiments, the reins optionally comprise a resilient tension absorber.

In embodiments of the above-described method, the trainee can be positioned downhill from and in front of the instructor on an inclined slope. The instructor can apply a greater rearward force on the right rein than on the left rein to induce the trainee to turn right, and can apply a greater rearward force on the left rein than on the right rein to induce the trainee to turn left. Furthermore, the instructor can apply rearward forces on both of the reins to restrain the trainee's downhill motion. In utilizing the method, the trainee ideally strives to achieve and maintain balance by responding to the instructor's discretionary input to the tethering points while also adjusting to the terrain and maneuver at hand.

In other embodiments of the above-described method, the trainee can be towed by the instructor along flat snow surfaces or up gentle inclines, by the instructor being positioned in front of the trainee, and applying forces on both of the reins to pull the trainee forward. Thus, a method is provided for towing trainees along flat snow surfaces or up gentle inclines for example to conserve energy of small children. As well as assisting the trainee in crossing such terrain, this can also help to develop the trainee's balance control. If the tethering point in use on the trainee is at the ankle, preferably it is repositioned to face forward.

An improved ski tip coupler, comprises a pair of ski tip anchors for attaching to the ski tips and a coupler for releasably finking the pair of ski tip anchors. The coupler comprises a rigid tube and a pair of connectors which are bound to each other by an elastic cord that extends through the tube, the connectors being releasably attachable to the ski tip anchors. During use of the ski tip coupler, the rigid tube limits convergence of the ski tips and preferably prevents the ski tips from crossing. Preferably the elastic cord limits the divergence or movement of the ski tips away from each other, and provides a resilient tendency to return the ski tips together to the length of the tube. In some embodiments, the length of the tube is adjustable, for example, the rigid tube can be telescopic.

Characterizing the various embodiments described herein, it can be stated that embodiments involving ankle tethering tend to grant the instructor a high degree of discretionary control over the trainee's speed and a strong influence over the trainee's direction and balance. Both the ski tip and ski tip handle tethering embodiments provide the instructor with an even higher degree of discretionary control over the trainee's direction and speed, as well as strong influence over the trainee's balance.

Toddlers, uncoordinated trainees or handicapped skiers are likely to be more effectively trained or assisted, and will tend to feel more secure, when tethered at the ski tips or at the ski tips via ski tip handles, while more coordinated or advanced trainees are likely to be more effectively trained or assisted by being tethered at the ankles.

The present device is easy-to-use, lightweight, convenient to carry and store, and can be easily attached to and removed from the trainee. For collision avoidance on busy slopes, the reins may be colored with high visibility fluorescent pigments and/or display an array of positioning lights to mark the usage of a tethering rein to other slope users.

Use of the present device and method benefits the trainee by speeding up the learning process, building up confidence and providing a fun experience.

DETAILED DESCRIPTION OF THE INVENTION

The present ski training device and method can be used to assist a trainee in achieving the appropriate weight shift, balance maintenance, and body stance to effectively initiate and execute basic ski maneuvers and the transitions between them. The instructor has influence over the trainee's tethering points via a left and right rein to guide, control or assist the trainee with said maneuvers. The tethering points are provided as a pair either at the ankles, the ski tips or the ski tips via ski tip handles. The training method is experiential, wherein the trainee learns and is assisted by an instructor as they ski together, for example, initially on a gentle incline.

For instance, in turning, the instructor exerts a stronger rearward force on one of the trainee's tethered sides, matching the instructor's intended direction, thus compelling the trainee to compensate for said manipulation by finding balance on the other side, triggering a turn. The trainee therefore works to complete a turn with a degree of upper body independence and autonomy, but nonetheless under the guidance of the instructor. The natural dynamic balance control mechanism of the skier is thus developed and enhanced in the process.

By having the trainee secured by the tethering points, the instructor is able to monitor and adjust the speed of the trainee by slowing down, and using the appropriate combination of tension and/or pull of each rein, while at the same time maintaining directional control.

Figure 1:
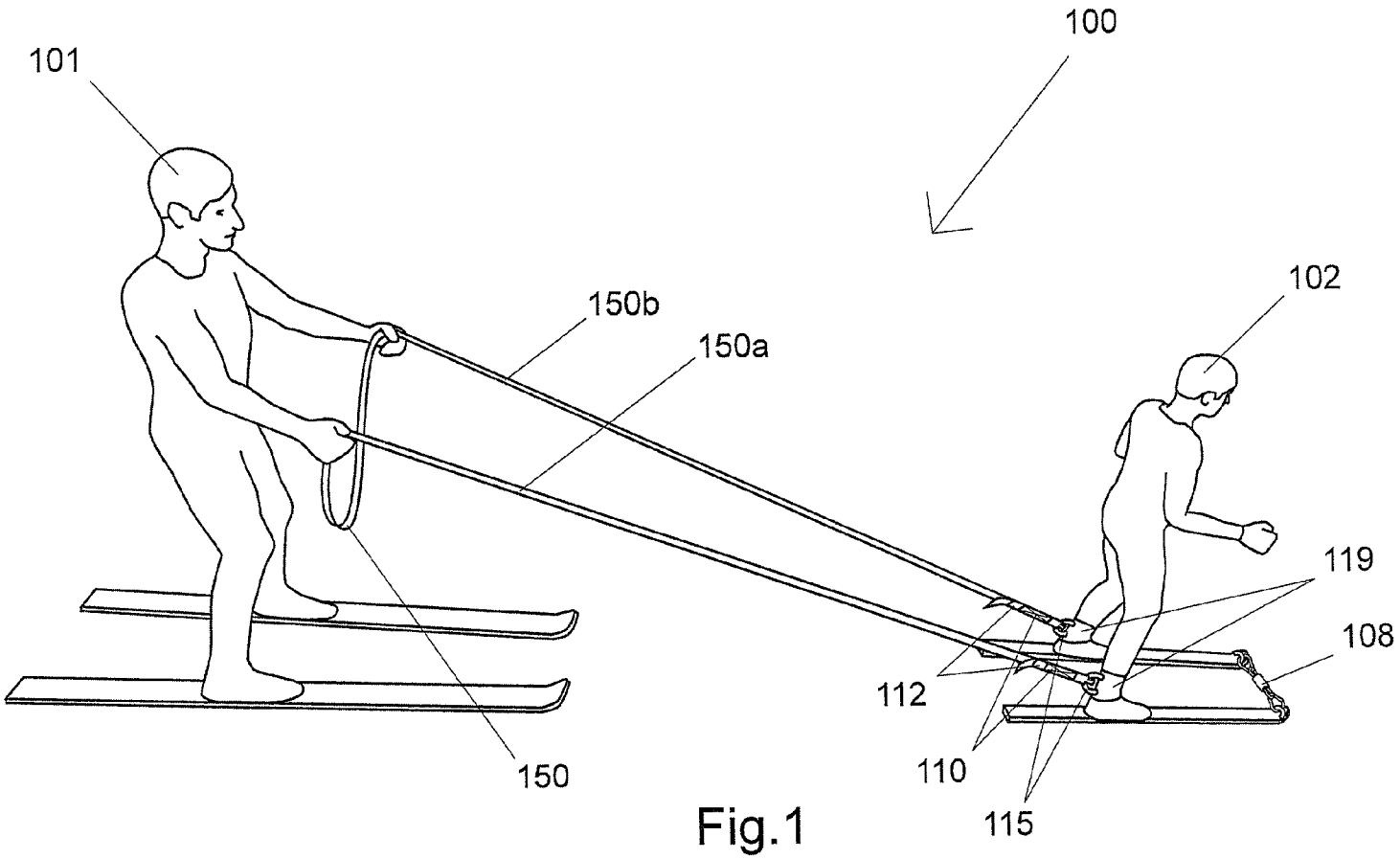
FIG. 1 shows a perspective view of an embodiment of a ski training device comprising a ski tip coupler and a pair of ankle tethering reins comprising a continuous line. The device is shown in use by a trainee and an instructor descending down a gentle incline.

Now, with reference to the drawings, FIG. 1 shows an instructor 101 assisting a trainee 102, with instructor 101 positioned behind and uphill from trainee 102. FIG. 1 also shows an embodiment of a ski training device 100 comprising a pair of ankle tethering reins 150*a* and 150*b* (comprising a continuous line 150), and a pair of connectors 115 and bands 119 that are wrapped around the trainee's boots at the ankles and secured, for example, by hook and loop or Velcro fasteners. In this embodiment instructor 101 holds, in each corresponding hand, right and left reins 150*a* and 150*b* which are secured to the trainee's ankles via connectors 115 that are attached to bands 119 which are wrapped around the trainee's boots at the ankles. The reins 150 can be adjusted to an appropriate length for different users and situations, for example, via buckle adjusters 112. Resilient tension absorbers 110 can be integrated into each rein as described in more detail below. In the illustrated embodiment, ski training device 100 also comprises a ski tip coupler 108 that can be attached to the trainee's ski tips, for example, to limit divergence of the trainee's ski tips. In using this embodiment of the device and method, the instructor 101 can gain a high degree of discretionary control over the trainee's speed and a strong influence over the trainee's direction and balance, while the trainee 102 can use this embodiment to autonomously derive the appropriate upper body balance for the maneuver and terrain at hand.

Figure 2:
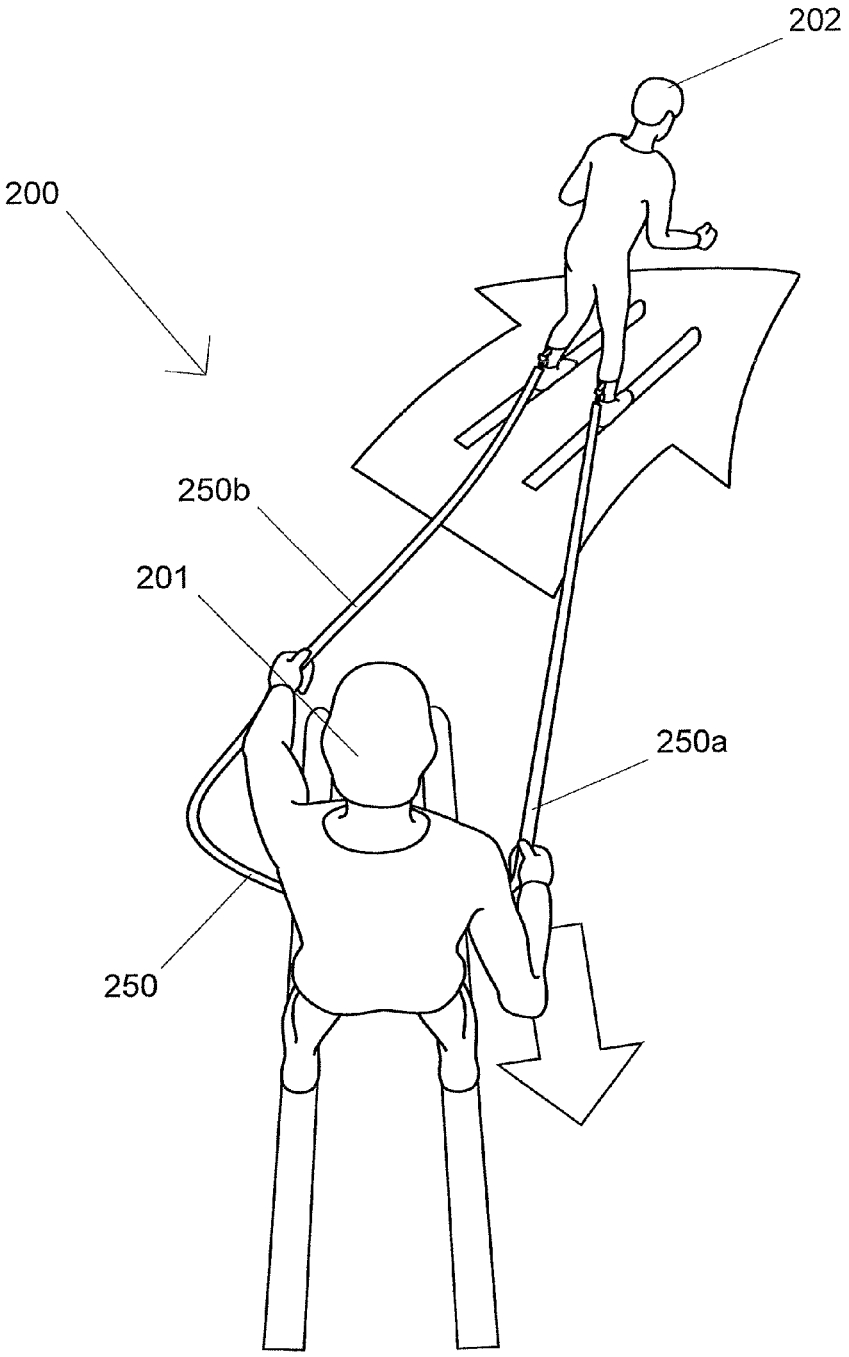
FIG. 2 shows a perspective view of an embodiment of a ski training device comprising a pair of ankle tethering reins. The device is shown in use by a trainee and an instructor turning right on a gentle downward incline.

FIG. 2 shows an instructor 201 using an embodiment of a ski training method and device 200 comprising a pair of ankle tethering reins 250*a* and 250*b* (comprising a continuous line 250), to induce a trainee 202 to turn right by pulling back on the right rein 250*a*. Instructor 201 can then accordingly induce trainee 202 to turn left by pulling back on the left rein 250*b*. Thus instructor 201 can have direct influence over the trainee's lower body via reins 250*a* and 250*b* to encourage the trainee 202 to shift his or her weight from one ski to the other, thereby triggering turns. Instructor 201 can stop or regulate the speed of trainee 202 by slowing down or stopping and applying tension and/or rearward forces on the reins 250*a* and 250*b* while maintaining some directional control over trainee 202.

Figure 3:
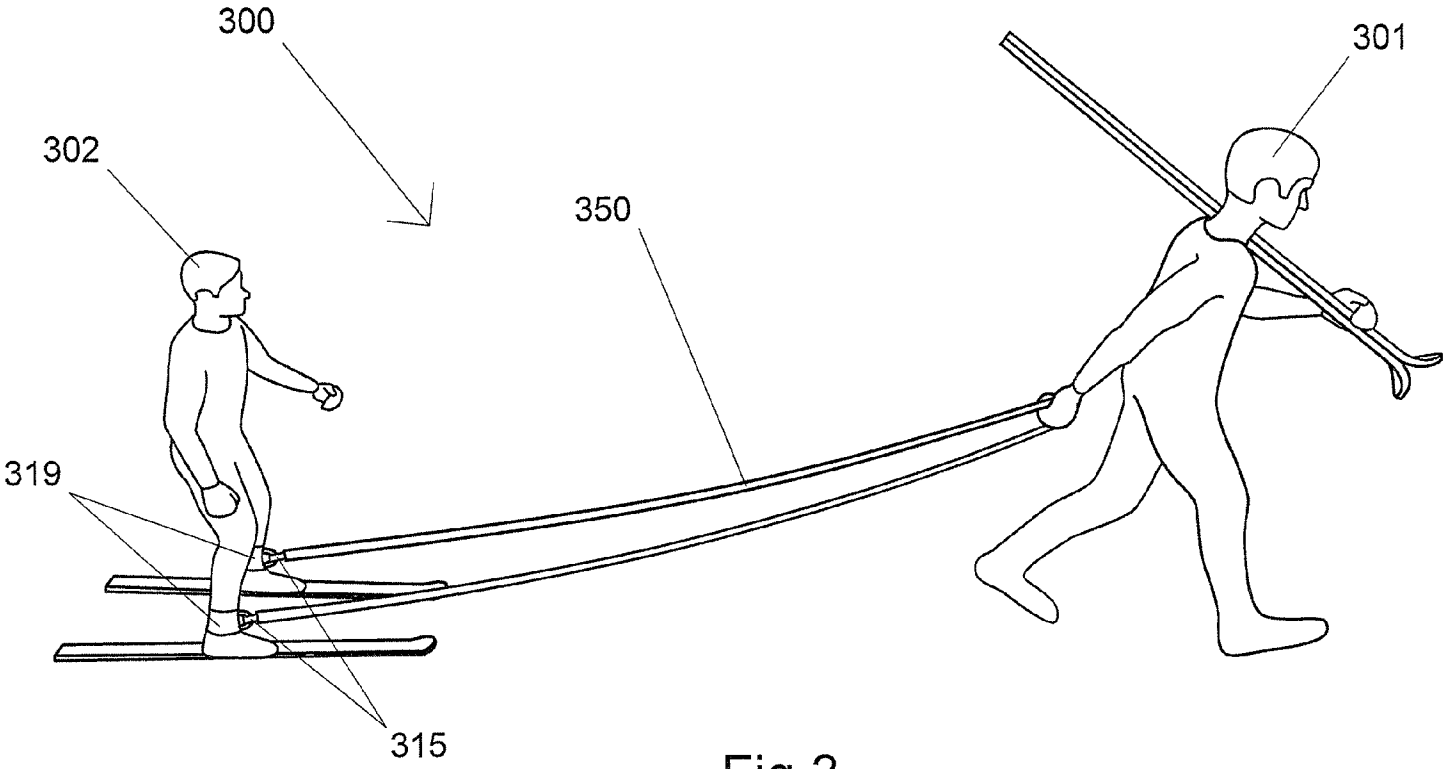
FIG. 3 shows a perspective view of an embodiment of a ski training device comprising a pair of ankle tethering reins. The device is shown in use by an instructor towing a trainee along substantially flat snowy terrain.

FIG. 3 shows an instructor 301 using an embodiment of a ski training method and device 300 comprising a pair of ankle tethering reins 350 to tow a trainee 302 along a flat surface or gentle incline. The instructor is positioned in front of the trainee and pulls the trainee by the reins 350. For this purpose, the trainee's boot bands 319, connectors 315, and reins 350 are re-oriented to face forward. When towing via ski tips or ski tip handles, then only the reins need to be resolved to face forward and the trainee may opt to grip the handles or not. The activity of towing, which may be performed by a walking or skiing instructor, encourages the trainee's balance control and conserves the trainee's energy, which is especially relevant for children who tend to get exhausted quickly when walking in snow while wearing ski gear. When towing, ski tip couplers are best removed, unless an adjustable or elastic kind is used that allows for ski walking and or ski separation, preferably within the boundaries of a relaxed parallel ski stance.

Figure 4:
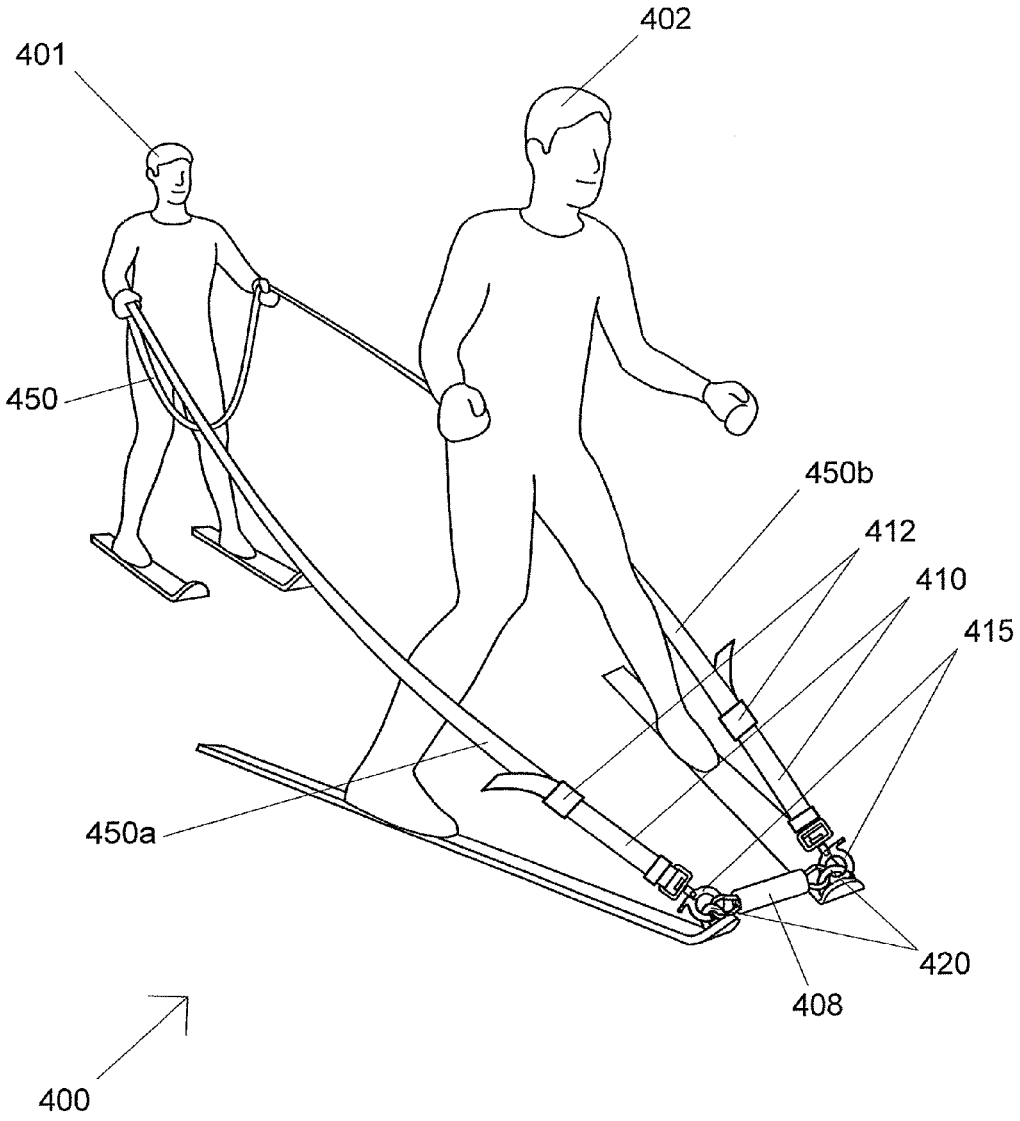
FIG. 4 shows a perspective view of an embodiment of a ski training device comprising a ski tip coupler and a pair of ski tip tethering reins comprising a continuous line. The device is shown in use by an instructor and trainee descending on a gentle incline.

FIG. 4 shows an instructor 401 assisting a trainee 402, with instructor 401 positioned behind and uphill from trainee 402. FIG. 4 also shows an embodiment of a ski training device 400 comprising a pair of ski tip tethering reins 450*a* and 450*b* (comprising a continuous line 450), a pair of connectors 415 and two ski tip anchors 420 (for example, eye bolts). In the illustrated embodiment, ski training device 400 also comprises a ski tip coupler 408 releasably attached to the trainee's ski tips via anchors 420 to limit divergence and/or convergence of the trainee's ski tips. In this embodiment instructor 401 holds, in each corresponding hand, right and left reins 450*a* and 450*b*. The reins are secured to ski tip anchors 420 via connectors 415. Reins 450*a* and 450*b* can be adjusted to an appropriate length for different users and situations, for example, via buckle adjusters 412. Resilient tension absorbers 410 can integrated into each rein as described in more detail below.

Figure 5:
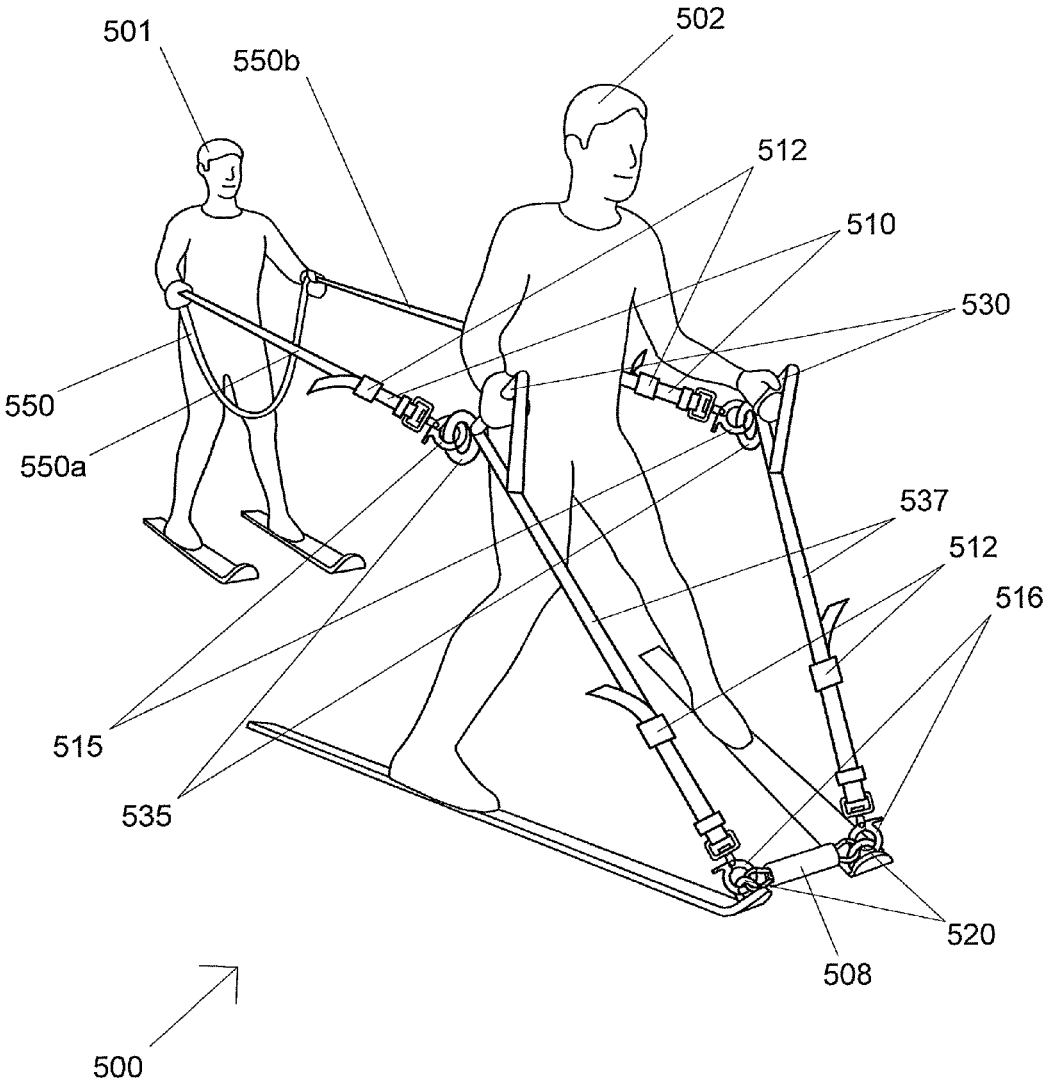
FIG. 5 shows a perspective view of an embodiment of a ski training device comprising a ski tip coupler, and a pair of ski tip handle tethering reins linked via ski tip handles and anchoring lines to the ski tips. The device is shown in use by an instructor and trainee descending down a gentle incline.

FIG. 5 shows an instructor 501 assisting a trainee 502, with instructor positioned behind and uphill from trainee 502. FIG. 5 also shows an embodiment of a ski training device 500 comprising a pair of ski tip handle tethering reins 550*a* and 550*b* (comprising a continuous line 550), a pair of handle-connectors 515, a pair of ski tip connectors 516, a pair of ski tip anchors 520, a pair of ski tip handles 530, and corresponding handle anchoring lines 537. In the illustrated embodiment, ski training device 500 also comprises a ski tip coupler 508 releasably attached to ski tip anchors 520 to limit divergence and/or convergence of the trainee's ski tips. In this embodiment, instructor 501 holds right and left reins 550*a* and 550*b* in each corresponding hand. The ends of these reins are secured to ski tip handle tethering points 535 via handle-connectors 515. Furthermore, ski tip handles 530 are connected to each corresponding ski tip anchor 520 via of anchoring lines 537 and ski tip connectors 516. Anchoring lines 537 and reins 550*a* and 550*b* can be adjusted to an appropriate length for different users and situations, for example, via buckle adjusters 512. For example, the lengths of handle anchoring lines 537 can be adjusted to allow trainee 502 to adopt a relaxed forward stance when gripping ski tip handles 530. Resilient tension absorbers 510 can be integrated into each rein as described in more detail below.

In using embodiments of the method and device described in FIG. 4 and FIG. 5, namely ski tip tethering and ski tip handle tethering, an instructor can gain a high degree of discretionary control over the trainee's direction and speed by exerting forces on the pair of reins (450*a* and 450*b* in FIGS. 4, and 550*a* and 550*b* in FIG. 5) as previously described for the embodiment in FIG. 2, while allowing the trainee to autonomously derive the appropriate upper body balance for the maneuver and terrain at hand. The ski tip handles 530, described for the embodiment illustrated in FIG. 5, FIG. 5, can provide the trainee with enhanced upper body stability and instructor with an indirect means to influence the trainee's upper body balance, making this a preferred embodiment for training or assisting toddlers, uncoordinated skiers of all ages and handicapped or disabled skiers.

In addition to manipulating the position and movement of the trainee using embodiments of the present device and method, the instructor may communicate instructions vocally to the trainee in anticipation of a particular maneuver to further facilitate turns and positioning, and to enhance the learning experience.

Figure 8A:
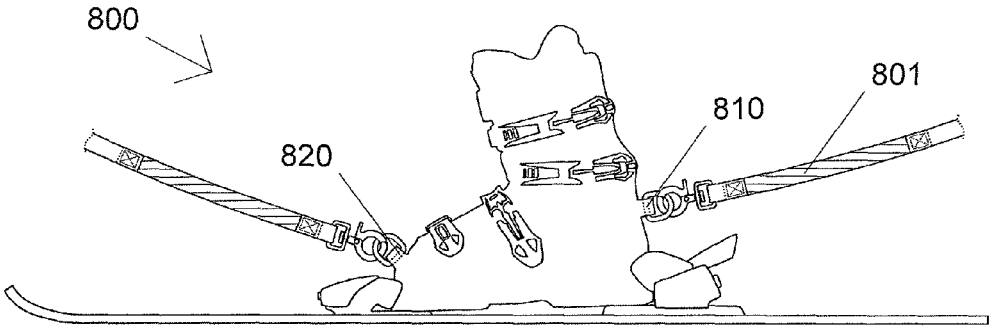
FIG. 8*a* shows a side view of an embodiment of a ski training device comprising a pair of ski boots (only the right boot is shown) with built in eye bolts in the front for towing and a built in eye bolts in the back for training purposes.

Preferably the reins have some degree of resilience or elasticity to prevent abrupt pulls, and to facilitate a gradual exertion of force on the trainee by the instructor. For example, some portion or the entire length of the reins can be made of a suitable elasticized or resilient material or "tension absorbers" can be integrated into the reins. FIG. 8*a* shows a section of elastic webbing 801 comprising elastic rubber rods threaded with non elastic yarn into an elastic strap, preferably capable of stretching one and half times its length.

The various embodiments of a ski training device described herein are preferably adjustable so that they can be adapted to suit a particular trainee by adjusting the various reins, connectors, and straps.

Figure 8B:
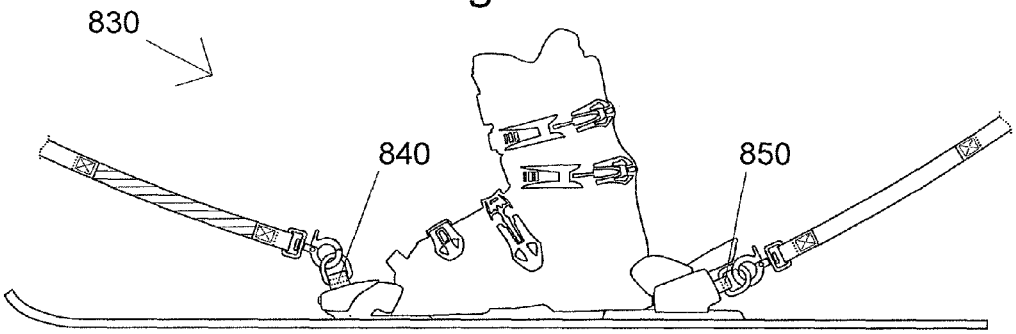
FIG. 8*b* shows a side view of an embodiment of a ski training device comprising a pair of front ski boot bindings with built in eye bolts for towing and a pair of rear ski boot bindings with built in eye bolts for training purposes.
Figure 8C:
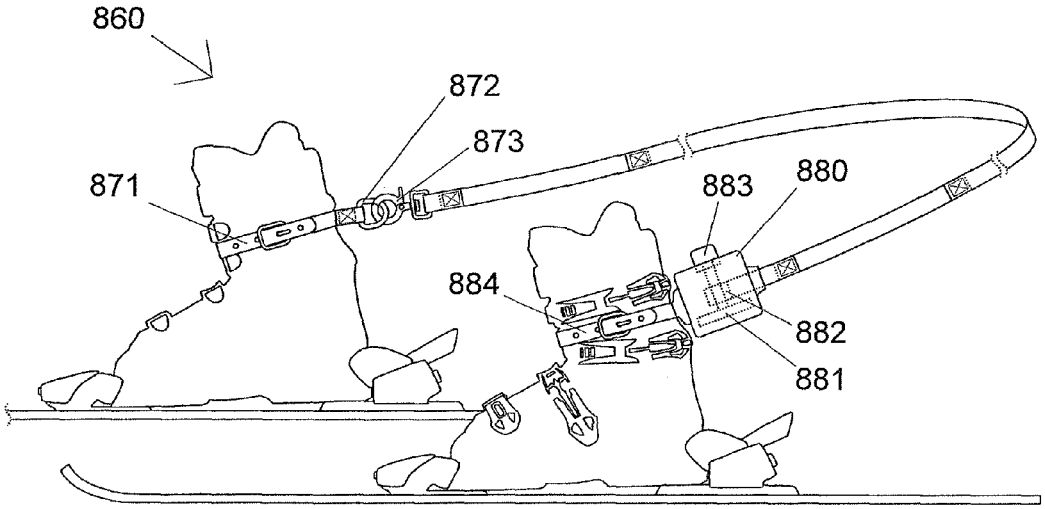
FIG. 8*c* shows a side view of an embodiment of a ski training device comprising a pair of ankle tethering reins further comprising a continuous retractable line, its receptacle, encasing a spring loaded retracting coil and associated connectors and strapping bands.

In more elaborate embodiments of the present device, a hydraulic, mechanical, electro-static or other suitable system may be used that, at the command of the instructor, causes a flexible and pliant rein to become firm and inflexible, so that a forward push can be exerted by the instructor using the rein instructor could employ this on any or all of the tethering points of the trainee to further adjust and correct body positioning.

in embodiments of the present device, the reins can be readily folded up and stored in a pouch or garment pocket when not in use, and can then be conveniently unraveled and re-attached without tangling when needed. Ski hill operators are typically concerned about loose clothing, equipment or straps that could be hazardous if they become caught in chair lifts, T-bars, gondolas or other equipment. FIG. 8*c* shows an embodiment of the device 860 comprising a continuous retractable rein one end of which can be conveniently disconnected from the trainee's ankle tethering point 872 by releasing connector 873 and wound up into roll 882 inside receptacle 880, which also encases a spring loaded coil 881 that can be unloaded or locked by pressing button 883. Receptacle 880 further comprises band 884 for securing receptacle 880, and hence the other end of the rein, to the opposite ankle of the trainee, around the boot. In other embodiments the reins can instead retract into receptacles held by the instructor, which would also allow him or her to adjust the length of the reins before and/or during use of the device.

Various types of fastener or attachment mechanisms can be used to fasten the reins to the trainee's clothing or equipment at the tethering points. For example, the ankle reins can comprise adjustable bands that encircle the ski boots at the ankle and are secured by hook and loop fasteners or buckled loops as illustrated by band 871 of FIG. 8*c*, Preferably the ankle connectors can be configured so that the reins extend rearwards for training purposes and forward for towing. Alternatively FIG. 8*a* shows one boot of a pair of ski boots comprising a rear built-in eye bolt 810 to which the reins can be attached for training purposes; and a front built-in eye bolt 820 to which the reins can be attached for towing. In another attachment configuration depicted in FIG. 8*b*, the ankle reins could attach to the ski bindings—for example, to the rear portion of the boot binding 850 for skiing, and to the front portion of the boot binding 840 for towing. Ski garments could have built-in loops at the gloves, wrists or pant bottoms for tethering the reins.

As mentioned above, the disclosed method and device can comprise a ski tip coupler to provide enhanced stability to the trainee's lower body. A ski tip coupler can be attached to the tips of the trainee's skis, for example, to ensure correct positioning of the skis within the position range of a wide parallel to a wedge, thus preventing the skis from straying into a diverging configuration that could lead to a fall. This is particularly beneficial in embodiments of the device in which the tethering points are at the ski tips, such as those illustrated in FIGS. 4 and 5. A ski tip coupler, if used, can be of a fixed or adjustable length and/or can be elastic. Preferably the length of the ski tip coupler is adjustable so that the maximum parallel separation can be set to allow for either snow plow (wedging) or parallel skiing, and can be set appropriately for each individual user.

Figure 6A:
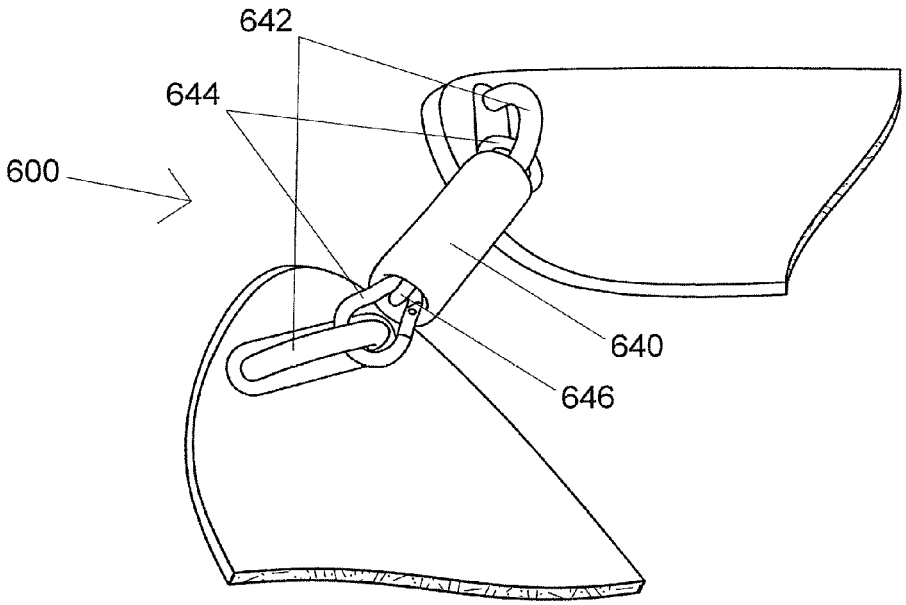
FIG. 6*a* shows a perspective view of an embodiment of a ski tip coupler.
Figure 6B:
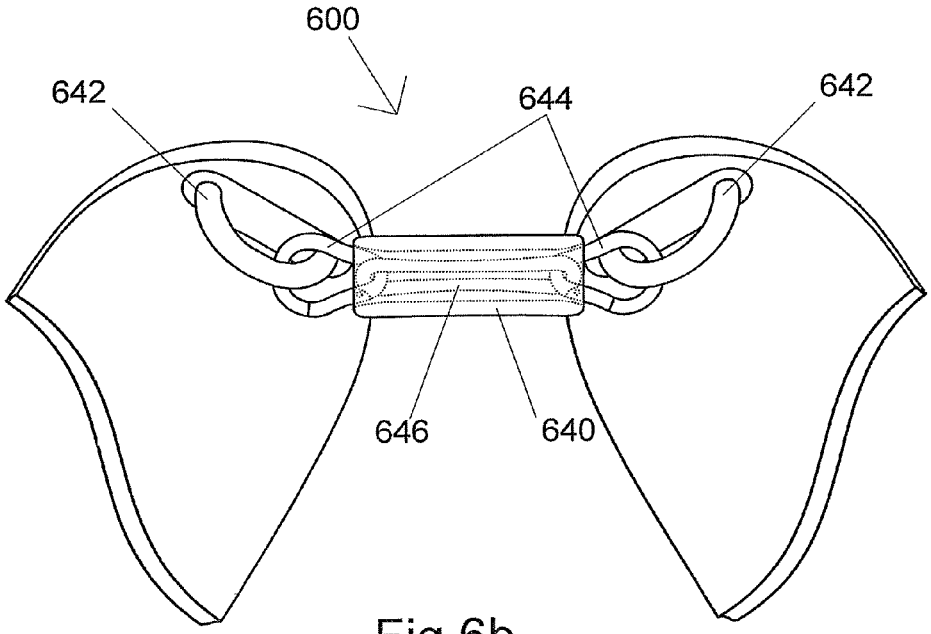
FIG. 6*b* shows a top view of the ski tip coupler shown in FIG. 6*a*, including a view of hidden internal parts of some of its components.
Figure 7A:
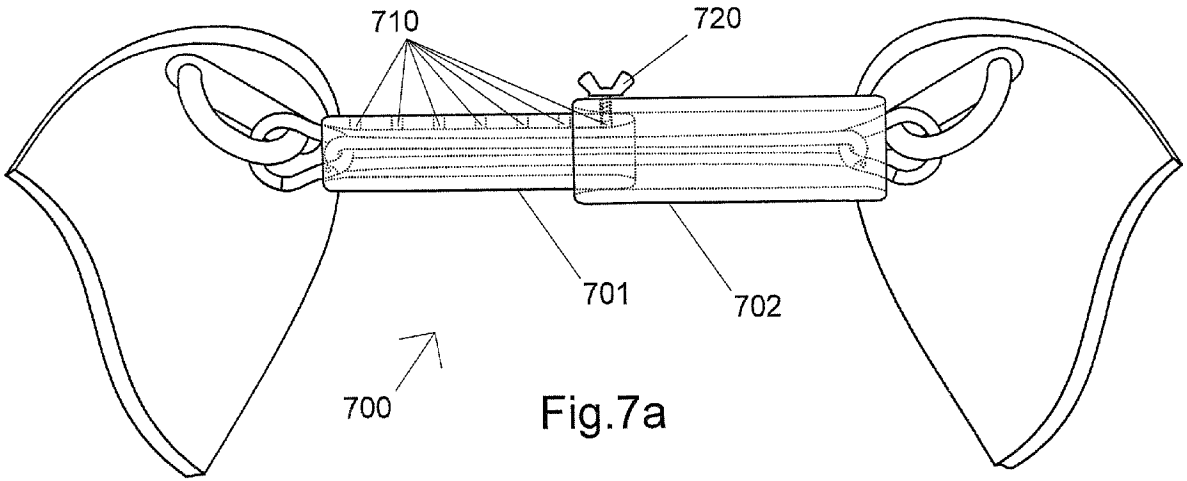
FIG. 7*a* shows a top view of an embodiment of a ski tip coupler comprising a telescopic rigid tube and locking bolt, including a view of hidden internal parts of some of its components.
Figure 7B:
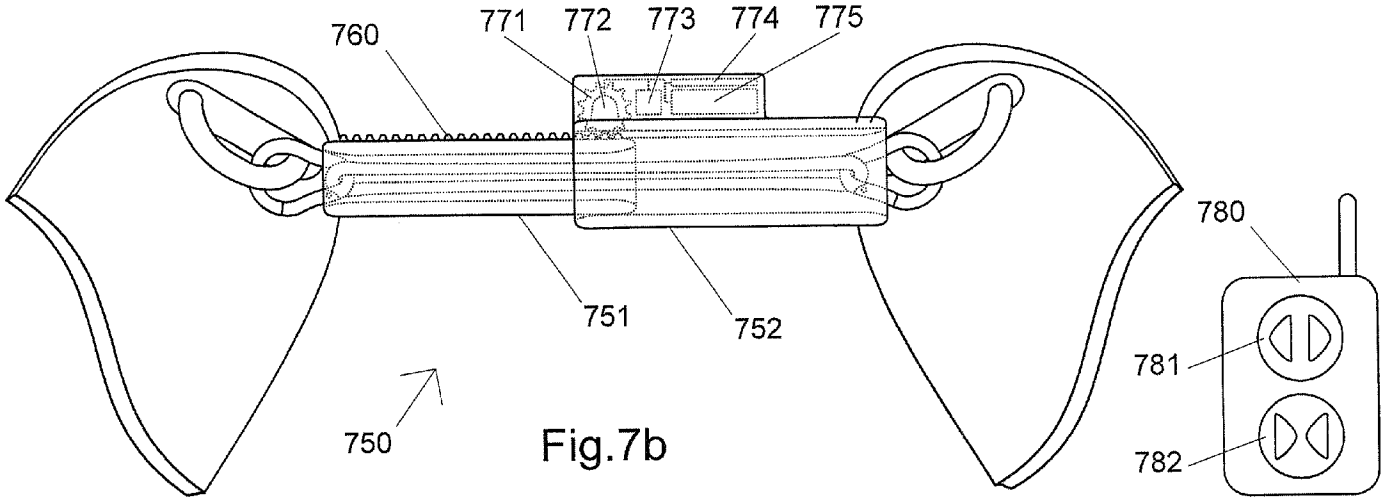
FIG. 7*b* shows a top view of an embodiment of a ski tip coupler comprising a remote controlled, adjustable telescopic rigid tube, including a view of hidden internal parts of some of its components.

FIG. 6*a* and FIG. 6*b* show an embodiment of an improved ski tip coupler 600, comprising a rigid tube 640 that is secured to each ski tip anchor 642 via connectors 644 that are threaded through an elastic cord loop 646 that extends through the inside of a rigid tube 640. This embodiment allows for the ski tips to diverge and also limits convergence of the ski tips. FIG. 7*a* shows an enhanced ski tip coupler embodiment 700, where tube 701 with tube 702 comprise a rigid telescopic tube whose length can be adjusted and locked with screw 720, either into holes 710 or by pressure against tube 701. FIG. 7*b* shows another enhanced ski tip coupler embodiment 750, where tube 751 with tube 752 comprise a rigid telescopic tube whose length can be adjusted and locked, during or prior to its use, via remote control 780. Tube 752 further comprises a battery 775, radio antenna 774, digital microprocessor 773, electric motor 772 and gear 771, which runs along dented track 760 on tube 751. Button 781 actuates radio signals which the components within tube 752 receive and trigger gear 771 to turn as to extend the over all length of the telescopic tubes. Alternatively, actuating button 782, reverses turning direction of gear 771 decreasing the overall length of the telescopic tubes. The extended length of these telescopic tubes limit the distance between the ski tips, and the contracted length of the telescopic tubes limiting the proximity between the ski tips. In another enhanced embodiment, an orifice at the center of the tube is provided, through which the elastic cord is threaded to provide two loops, one at each end of the tube. At this orifice a fastener then holds two resulting lengths of the elastic cord, each end having a stopper to prevent the un-threading of the elastic cord through the tube's orifice. This fastener allows for adjusting the length of the elastic cord available inside the tube, from loop to loop, and hence regulating the maximum possible distance between the ski tips, preferably sufficient to allow for parallel skiing or limited walking with the skis. In contrast to conventional ski tip couplers, the present embodiments of the coupler provide the dual utility of limiting ski tips convergence while also allowing convergence while also allowing the ski tips to diverge up to a set distance. Any of the embodiments of the present ski tip coupler can be advantageously used as part of the present method and device, particularly when the trainee is uncoordinated and or a young child.

Various types of anchoring mechanisms can be used to temporarily attach them to the front portion of the skis. Examples include clamps or grips which grip the upper and lower surfaces of the skis, loops that encircle and can be tightened around the front portion of each ski, or a hook-and-eye type of mechanism where an eye bolt is screwed or riveted through the top surface of each ski and the connector has a hook or clip at each end which can be clipped to the eye bolts. The ski tip coupler and the reins can be connected to the ski tips via the same ski tip anchor, or via different components.

Consideration should be given to the size and weight of the trainee relative to the instructor. Most embodiments of the method are particularly suitable for an adult instructing a child trainee. The closer the instructor and trainee are in size, the more capable a skier the instructor must be in order to manage guiding and regulating the speed and movement of the trainee.

While particular elements, embodiments and applications of the present disclosure have been shown and described, it will be understood that the scope of the disclosure is not limited thereto, since modifications can be made by those skilled in the art without departing from the scope of the present disclosure, particularly in light of the foregoing teachings.

What is claimed is:

1. A method of assisting a trainee skier, comprising:

securing left and right reins independently of each other to left and right ski boots of the trainee, respectively; and holding each rein at an opposite side thereof from the boots and directly adjusting the motion of the boots of the trainee independently of each other by applying forces from each rein independently of each other to each boot via each rein.

2. The method of claim 1, wherein the left and right reins are secured at an ankle of the boots.

3. The method of claim 1, wherein:

the opposite side of the reins are held by another skier; and the other skier adjusts the motion of the left ski boot using the left rein and of the right ski boot using the right rein.

4. The method of claim 3, wherein the other skier is an instructor.

5. The method of claim 1, further comprising applying a rearward force on one of the held reins to move the boot connected thereto backwards with respect to the other boot, without significantly adjusting the motion of the other boot.

6. The method of claim 1, further comprising applying a greater rearward force on the held side of one of the reins to induce the trainee to shift his or her weight from one boot to the other and turn in the direction of said one of the reins.

7. The method of claim 6, further comprising applying reward forces together on both held sides of the reins to restrain the motion of or stop both boots and the trainee.

8. The method of claim 1, further comprising providing a ski training device, comprising:

the left and right reins;

a left ankle tethering member connected to the left rein to provide a left member; and a right ankle tethering member connected to the right rein to provide a right member;

wherein the left and right members are separate from each other from the respective ankles to the held opposite sides.

9. The method of claim 8, wherein the ski training device further comprises ski tip couplers that are attached to ski tips of the trainee.

10. The method of claim 8, wherein the left and right ankle tethering members include left and right ankle bands, respectively, the left and right ankle bands wrapped and secured around the left and right boots of the trainee, respectively, to provide the secure connection of the ankle tethering members to ankles of the boot.

11. The method of claim 8, further comprising:

a left connecting portion connecting the left rein to the left ankle tethering member; and a right connecting portion connecting the right rein to the right ankle tethering member;

wherein the connections of the connecting portions to the ankle tethering portions are sufficiently secure to apply forces from the reins independently on the ankle tethering members and boots.

12. The method of claim 8, wherein the ankle tethering members are free of connections to each other that restrict movement therebetween when secured to the boots.

13. The method of claim 8, wherein the left and right ankle tethering members further comprising:

a left attachment member mounted to the left boot to connect the left rein to the left ankle tethering member; and a right attachment member mounted to the right boot to connect the right rein to the right ankle tethering member;

wherein the attachment members sufficiently secure the reins to the ankle tethering members to apply forces from the reins independently on the ankle tethering members and boots to allow the instructor holding the reins to directly and independently adjust the motion of each boot.

14. The method of claim 13, wherein the attachment members are affixed securely to the boots.

15. The method of claim 1, wherein the left and right reins are separate from each other from the respective ankles to the respective held opposite sides.

16. A method of assisting a trainee skier, comprising:

providing a ski training device, comprising:

left and right reins, and left and right ankle tethering members connected independently to the left and right reins, respectively;

securing the left and right ankle tethering members independently of each other to left and right ski boots, respectively, of the trainee; and holding an opposite side of the reins from the boots and directly and independently adjusting the motion of the boots of the trainee by applying forces from each rein independently to each boot via each rein.

17. The method of claim 16, further comprising applying a rearward force on one of the held reins to manipulate the motion of the boot connected thereto without significantly adjusting the motion of the other boot.

18. The method of claim 17, wherein the left and right ankle tethering members include left and right ankle bands, respectively, the left and right ankle bands wrapped and secured around the left and right boots of the trainee, respectively, to provide the secure connection of the ankle tethering members to ankles of the boot.

19. The method of claim 17, further comprising:

a left connecting portion connecting the left rein to the left ankle tethering member; and a right connecting portion connecting the right rein to the right ankle tethering member;

wherein the connections of the connecting portions to the ankle tethering portions are sufficiently secure to apply forces from the reins independently on the ankle tethering members and boots to allow the instructor holding the reins to adjust the motion of the trainee.

20. The method of claim 17, wherein the ankle tethering members are free of connections to each other that restrict movement therebetween when secured to the boots.

21. The method of claim 16, further comprising applying a greater rearward force on the held side of one of the reins to induce the trainee to shift his or her weight from one boot to the other and turn in the direction of said one of the reins.

22. The method of claim 16, further comprising applying reward forces together on both held sides of the reins to restrain the motion of or stop both boots and the trainee.

23. The method of claim 16, wherein the left connected rein and tethering portion are separate from the right connected rein and tethering portion from the respective ankles to the respective held opposite sides.

* * * * *